US009263808B2

(12) United States Patent
Kawamura et al.

(10) Patent No.: US 9,263,808 B2
(45) Date of Patent: Feb. 16, 2016

(54) CONNECTION STRUCTURAL BODY, CONNECTOR AND METHOD OF MANUFACTURING CONNECTION STRUCTURAL BODY

(71) Applicants: FURUKAWA ELECTRIC CO., LTD., Tokyo (JP); FURUKAWA AUTOMOTIVE SYSTEMS, INC., Inukami-gun (JP)

(72) Inventors: Yukihiro Kawamura, Tokyo (JP); Takashi Tonoike, Tokyo (JP); Satoshi Takamura, Tokyo (JP)

(73) Assignees: Furukawa Electric Co., Ltd., Tokyo (JP); Furukawa Automotive Systems, Inc., Inukami-gun (JP)

( * ) Notice: Subject to any disclaimer, the term of this patent is extended or adjusted under 35 U.S.C. 154(b) by 0 days.

(21) Appl. No.: 14/553,509

(22) Filed: Nov. 25, 2014

(65) Prior Publication Data

US 2015/0079857 A1 Mar. 19, 2015

Related U.S. Application Data

(63) Continuation of application No. PCT/JP2013/069690, filed on Jul. 19, 2013.

(30) Foreign Application Priority Data

Jul. 20, 2012 (JP) ..... 2012-162074
Jul. 20, 2012 (JP) ..... 2012-162075

(51) Int. Cl.
*H01R 4/20* (2006.01)
*H01R 43/048* (2006.01)
(Continued)

(52) U.S. Cl.
CPC ..... *H01R 4/20* (2013.01); *H01R 43/048* (2013.01); *H01R 43/0482* (2013.01); *H01R 43/16* (2013.01); *H01R 4/62* (2013.01); *H01R 13/52* (2013.01)

(58) Field of Classification Search
CPC ..... H01R 4/206; H01R 4/62; H01R 13/52; H01R 4/20; H01R 43/0482; H01R 4/183; H01R 43/0221
USPC ..... 439/877, 421, 834, 868, 879–882, 442, 439/730, 406; 29/860
See application file for complete search history.

(56) References Cited

U.S. PATENT DOCUMENTS 7,048,551 B2 * 5/2006 Takayama ..... 439/67
7,828,611 B2 * 11/2010 Nakamura et al. ..... 439/877
(Continued)

FOREIGN PATENT DOCUMENTS

CN 101645545 A 2/2010
CN 101842939 A 9/2010
(Continued)

OTHER PUBLICATIONS

International Search Report for PCT/JP2013/069690 dated Oct. 22, 2013.
(Continued)

*Primary Examiner* — Edwin A. Leon
(74) *Attorney, Agent, or Firm* — Oblon, McClelland, Maier & Neustadt, L.L.P.

(57) ABSTRACT

There is provided a pressure-bonding connection structural body and a female connector which can surely prevent the intrusion of moisture from an insulating cover side, and a method of manufacturing the connection structural body. In the connection structural body which is configured by connecting a crimp terminal and an insulated wire to each other, the crimp terminal having a barrel portion which is an integral body formed of; a cover pressure-bonding section which pressure-bonds by caulking the insulating cover; and a core wire pressure-bonding section which pressure-bonds an aluminum core wire by caulking, a water blocking projecting portion which prevents the intrusion of moisture in a longitudinal direction in a pressure-bonding state is formed, at the time of pressure-bonding the barrel portion, on an inner surface of the cover pressure-bonding section of the barrel portion where a cross-sectional shape in a width direction is formed into a closed cross-sectional shape.

12 Claims, 8 Drawing Sheets

(51) Int. Cl.

| | |
|---|---|
| ***H01R 43/16*** | (2006.01) |
| *H01R 4/62* | (2006.01) |
| *H01R 13/52* | (2006.01) |

(56) References Cited

U.S. PATENT DOCUMENTS

| | | | | |
|---|---|---|---|---|
| 7,896,712 | B2 * | 3/2011 | Cecil et al. | 439/730 |
| 9,028,284 | B2 * | 5/2015 | Lengert et al. | 439/877 |

FOREIGN PATENT DOCUMENTS

| | | | |
|---|---|---|---|
| JP | 64-009361 | U | 1/1989 |
| JP | 2010-45007 | | 2/2002 |
| JP | 2002-216862 | | 8/2002 |
| JP | 2011-081918 | A | 4/2011 |

OTHER PUBLICATIONS

Japanese Decision to grant a patent in the Japanese Application No. 2013-544900, date Mar. 17, 2014 (with English translation).

Office Action issued Dec. 24, 2013 in Japanese Patent Application No. 2013-544900, with English translation.

Office Action issued Jan. 30, 2015 in Chinese Patent Application No. 201380007927.1, with English translation.

Search Report issued Jul. 19, 2013 in Chinese Patent Application No. 201380007927.1, with English translation.

Decision to Grant a Patent issued Oct. 29, 2014 in Korean Patent Application No. 10-2014-7022391, with English translation.

Decision to Grant a Patent issued Jul. 15, 2015 in Chinese Patent Application No. 20138007927.1, with English translation.

* cited by examiner

CONNECTION STRUCTURAL BODY, CONNECTOR AND METHOD OF MANUFACTURING CONNECTION STRUCTURAL BODY

CROSS REFERENCE TO RELATED APPLICATION

The present application is a Continuation Application of PCT/JP2013/069690, filed on Jul. 19, 2013, and the PCT Application is based upon and claims the benefit of priority from Japanese Patent Application Nos. 2012-162074, filed on Jul. 20, 2012 and 2012-162075, filed on Jul. 20, 2012. The entire contents of each of the above-noted documents are incorporated herein by reference in their entirety.

TECHNICAL FIELD

The present invention relates to, for example, a connection structural body which can be mounted on a connector of a wire harness for an automobile or the like, a connector and a method of manufacturing a connection structural body.

BACKGROUND ART

There has been proposed an electric apparatus mounted on an automobile or the like where an electric circuit is formed by connecting such an electric apparatus with another electric apparatus or a power source device through a wire harness which is formed by binding insulated wires. In this case, the wire harness, the electric apparatus and the power source device are connected to each other by connecting connectors which are mounted on these components.

With respect to these connecters, a crimp terminal which is connected to the insulated wire by pressure-bonding is incorporated in the inside of the connector. A female connector and a male connector which are connected in concave and convex relationship are configured to be engaged with each other by fitting engagement.

Such connectors are used under various environments and hence, there may be a case where unintended moisture adheres to a surface of the insulated wire due to condensation brought about by a change in ambient temperature or the like. There is a drawback that, when moisture intrudes into the inside of the connector along the surface of the insulated wire, a surface of a wire conductor exposed from a distal end of the insulated wire corrodes.

In view of the drawback, there have been proposed various techniques which prevent the intrusion of moisture into a wire conductor pressure-bonded by a crimp terminal.

For example, the water blocking structure of a wire described in Patent Document 1 is configured such that, in a crimp terminal which includes a core wire barrel which pressure-bonds a core wire of the wire, and an insulating cover barrel which pressure-bonds an insulating cover layer of the wire, the core wire barrel and the insulating cover barrel are covered with a heat shrinkage tube together with the insulating cover layer of the wire pressure-bonded on the crimp terminal thus preventing the intrusion of moisture from the insulating cover layer.

However, the water blocking structure of a wire described in Patent Document 1 requires a step of mounting the heat shrinkage tube and a step of heating the heat shrinkage tube. Further, the water blocking structure requires a time for surely shrinking the heat shrinkage tube. Accordingly, there is a drawback that the water blocking applied to the core wire barrel which pressure-bonds the core wire of the wire requires a large number of man-hours.

Further, the heat shrinkage tube is exposed to the outside air and hence, it is difficult to suppress the deterioration or degradation with time, and there is a possibility that the heat shrinkage tube is deformed or damaged so that moisture intrudes into the wire.

PRIOR ART DOCUMENT

Patent Document

Patent Document 1: Japanese Laid-open Patent Publication No. 2011-81918

SUMMARY OF THE INVENTION

Problems to be Solved by the Invention

The present invention has been made in view of the above-mentioned drawback, and it is an object of the present invention to provide a connection structural body and a connector which can surely prevent the intrusion of moisture from a cover body side, and a method of manufacturing a connection structural body.

Solutions to the Problems

According to the present invention, there is provided a connection structural body which is configured by connecting a crimp terminal and an insulated wire which is formed by covering an outer periphery of a wire conductor with an insulating cover body to each other, the crimp terminal having a barrel portion which is formed of: a cover pressure-bonding section which pressure-bonds by caulking the cover body in the vicinity of a distal end of the cover body; and a conductor pressure-bonding section which pressure-bonds by caulking the wire conductor which is exposed from the distal end of the cover body by a predetermined length in a long length direction of the insulated wire, wherein the barrel portion is formed of: the cover pressure-bonding section which is configured such that a cross-sectional shape of the cover pressure-bonding section in a short length direction of the insulated wire is formed into a closed cross-sectional shape which surrounds the cover body, and the cover pressure-bonding section extends by a predetermined length in the long length direction; and the conductor pressure-bonding section which is configured such that the cover pressure-bonding section is formed by extending the cover pressure-bonding section in the long length direction, and a cross-sectional shape of the conductor pressure-bonding section in a short length direction is formed into a closed cross-sectional shape which surrounds the wire conductor, and a compression portion which is formed into a projection shape and projects toward the center of the insulated wire in the short length direction from an inner surface of the cover pressure-bonding section at the time of pressure-bonding the cover body by caulking the barrel portion is disposed on a boundary between an inner surface of the cover pressure-bonding section and an outer surface of the cover body.

The barrel portion may be formed of a closed barrel-type where the barrel portion has an inner hollow shape.

The closed cross-sectional shape may be a closed cross-sectional shape formed by welding edge portions of the barrel portion, a closed cross-sectional shape formed integrally by welding overlapping edge portions of the barrel portion or the like.

Due to the present invention, the connection structural body can surely prevent the intrusion of moisture from a cover body side.

This will be described in more detail. The connection structural body includes the cover pressure-bonding section, the conductor pressure-bonding section, and the compression portion having each having a closed cross-sectional shape as the cross-sectional shape in the short length direction and the water blocking means and hence, the barrel portion can prevent the intrusion of moisture into the inside of the cover pressure-bonding section from an end portion of the barrel portion on a cover body side. Further, by sealing or hermetically sealing an end portion of the barrel portion on a wire conductor side, for example, it is possible to surely prevent the intrusion of moisture into the inside of the barrel portion from both ends of the barrel portion in the long length direction.

The connection structural body further includes the compression portion which is formed at the time of pressure-bonding the barrel portion on a boundary between the cover body and the cover pressure-bonding section. Accordingly, the connection structural body can suppress the degradation with time or the like of the compression portion due to the exposure to outside air and, at the same time, can prevent the occurrence of damage on the compression portion due to an external factor. Accordingly, the connection structural body can surely and continuously prevent the intrusion of moisture into the inside of the cover pressure-bonding section in a pressure-bonding state.

Accordingly, the connection structural body can surely prevent the intrusion of moisture into the inside of the cover pressure-bonding section in a pressure-bonding state.

As described above, the compression portion may be formed into a projection shape which projects toward the center of the wire conductor in the short length direction from the inner surface of the cover pressure-bonding section.

The projection shape may be an approximately convex shape, a crest shape, or a shape formed by narrowing a diameter of the cover pressure-bonding section or the like in cross section in the long length direction With this invention, the connection structural body can secure water-blocking performance more surely by the compression portion.

Specifically, by forming the compression portion into a projection shape, the cover body can be compressed more surely. Moreover, the cover body is deformed into an approximately uneven shape by the compression portion having a projection shape, and hence, it is possible to make an intrusion path of moisture more complicated and to elongate a distance of the intrusion. path. Accordingly, it is possible to make it more difficult for moisture intruded into a gap formed between the cover body and the cover pressure-bonding section to reach the wire conductor.

In addition to the above, the compression portion having a projection shape bite into the cover body due to pressure-bonding and hence, even when a pulling force is applied to the cover body in the long length direction by chance, it is possible to prevent the wire conductor from being easily removed from the crimp terminal.

Therefore, in the connection structure, the compression portion is formed into a projection shape, and hence it is possible to secure water-blocking performance more surely.

According to another aspect of the present invention, the compression portion may be formed into a projection shape and project toward the center of the insulated wire in the short length direction from the inner surface of the cover pressure-bonding section.

The above-mentioned projection shape may be an approximately convex shape, an approximately crest shape, a shape formed by narrowing a diameter of the cover pressure-bonding section or the like in cross section in the long length direction.

According to the present invention, the connection structural body can more effectively enhance water-blocking performance acquired by the compression portion.

This will be described in more detail. By forming the compression portion into a projection shape in the short length direction, the cover body can be compressed more surely. Still further, the cover body is deformed into an approximately uneven shape by the compression portion having a projection shape and hence, it is possible to make an intrusion path of moisture more complicated and to elongate a distance of the intrusion path. Accordingly, it is possible to make it more difficult for moisture intruded into a gap formed between the cover body and the cover pressure-bonding section to reach the wire conductor.

In addition to the above, the compression portion having a projection shape bites into the cover body due to pressure-bonding and hence, even when a pulling force is applied to the insulated wire in the long length direction by chance, it is possible to prevent the insulated wire from being easily removed from the crimp terminal.

Accordingly, the connection structural body can secure water-blocking performance more surely by forming the compression portion in a projection shape.

According to another aspect of the present invention, a sealing member having waterproof property may be formed on an inner peripheral surface of the cover pressure-bonding section or on an outer peripheral portion of the cover body in the vicinity of the distal end of the cover body.

The sealing member is made of a resin material having waterproof property, and is formed by applying the resin material to an inner peripheral surface of the cover pressure-bonding section or an outer peripheral surface of the cover body by covering or by laminating a sheet-like resin material to the inner peripheral surface of the cover pressure-bonding section or the outer peripheral surface of the cover body using an adhesive agent.

According to the present invention, the sealing member is brought into close contact with the cover pressure-bonding section and the cover body at the time of caulking the cover pressure-bonding section and hence, the gap formed between the cover body and the cover pressure-bonding section can be closed in a pressure-bonding state. Accordingly, the crimp terminal can easily stop moisture which intrudes into the inside of the cover pressure-bonding section along the surface of the cover body.

Further, by using the sealing member in combination with the above-mentioned compression portion, the crimp terminal can surely secure water-blocking performance in a pressure-bonding state.

Accordingly, the crimp terminal can secure water-blocking performance more surely by easily closing the gap formed between the cover body and the cover pressure-bonding section using a sealing member.

According to another aspect of the present invention, the barrel portion may include a sealing portion which is formed by extending the conductor pressure-bonding section in the long length direction, and seals a distal end of the barrel portion in the long length direction.

According to the present invention, the connection structural body can prevent the intrusion of moisture from the opening formed in the barrel portion on a wire conductor side. Further, due to the provision of the sealing portion and the above-mentioned compression portion, the crimp terminal can bring the inside of the barrel portion in a pressure-bonding state into a hermetically closed state. Due to such a configuration, the connection structural body can prevent the intrusion of moisture into the inside of the barrel portion more surely.

Accordingly, by bringing the inside of the barrel portion in a pressure-bonding state into a hermetically closed state, the connection structural body can secure more stable conductivity while surely acquiring water-blocking performance.

According to another aspect of the present invention, the cover pressure-bonding section may include a proximal-end-side large-diameter inner peripheral portion where an inner peripheral portion of at least a proximal end portion of the pressure-bonding section in the long length direction has an inner diameter larger than inner diameters of portions other than the at least the proximal end portion in the long length direction of the pressure-bonding section.

According to the present invention, the cover pressure-bonding section may include the proximal-end-side large-diameter inner peripheral portion where the inner peripheral portion of at least the proximal end portion of the pressure-bonding section in the long length direction has the inner diameter larger than inner diameters of portions other than the at least the proximal end portion in the long length direction of the pressure-bonding section. Due to such a configuration, the inner diameter of the inner peripheral portion of the at least the proximal end portion of the pressure-bonding section can surely have the inner diameter larger than inner diameters of portions of the pressure-bonding section other than the at least the proximal end portion. Accordingly, in a state where the pressure-bonding section is pressure-bonded to a distal end portion of the wire, a pressure-bonding force with which a proximal end side of the cover pressure-bonding section crimps the insulating cover can be alleviated thus preventing a drawback that the insulating cover ruptures.

According to another aspect of the present invention, the wire conductor may be formed using an aluminum-based material, and at least the barrel portion may be formed using a copper-based material.

According to the present invention, the insulated wire can be made light-weighted compared to an insulated wire having a wire conductor made of a copper wire and, at the same time, it is possible to prevent the so-called dissimilar metal contact corrosion (hereinafter referred to as "galvanic corrosion") due to the above-mentioned reliable water-blocking performance.

This will be described in more detail. When a copper-based material which has been conventionally used as a material for forming a wire conductor of an insulated wire is replaced with an aluminum-based material such as aluminum or an aluminum alloy and the wire conductor made of an aluminum-based material is pressure-bonded to a crimp terminal, due to contact between the aluminum-based material and a nobler metal material such as tin plating, gold plating or a copper alloy which is a material for forming a terminal, there arises a phenomenon that the aluminum-based material which is a less noble metal corrodes, that is, an galvanic corrosion as a drawback.

"Galvanic corrosion" is a phenomenon that when moisture adheres to a portion where a nobler metal material and a less noble metal contact with each other, a corrosion electric current is generated, and the less noble metal corrodes, is melted and is dissipated. Due to such a phenomenon, a conductor portion made of an aluminum-based material pressure-bonded to a pressure-bonding section of a crimp terminal corrodes, is melted and is dissipated and, eventually, electric resistance increases. As a result, there arises a drawback that the crimp terminal cannot achieve a sufficient conduction performance.

However, due to the above-mentioned reliable water-blocking performance, the insulated wire of the present invention can prevent so-called galvanic corrosion while making the insulated wire light-weighted compared to an insulated wire having a conductor portion made of a copper-based material.

According to another aspect of the present invention, there is provided a wire harness formed by binding a plurality of connection structural bodies described above.

According to the present invention, it is possible to form a wire harness which secures stable conductivity irrelevant to the kinds of metals which form the crimp terminal and the wire conductor.

According to another aspect of the present invention, there is provided a connector where the crimp terminal in the connection structural body described above is arranged in the inside of a connector housing.

According to the present invention, it is possible to connect the crimp terminal while ensuring stable conductivity irrelevant to the kinds of metals which form the crimp terminal and the wire conductor.

This will be described in more detail. For example, at the time of connecting the crimp terminals arranged in the inside of the connector housings of the respective connectors by making the female connector and the male connector engage with each other by fitting engagement, it is possible to connect the crimp terminals of the respective connectors with each other while ensuring water-blocking performance.

Accordingly, the connector can secure a connection state with reliable conductivity.

According to another aspect of the present invention, there is provided a method of manufacturing a connection structural body which is configured by connecting a crimp terminal and an insulated wire which is formed by covering an outer periphery of a wire conductor with an insulating cover body to each other, the crimp terminal having a barrel portion which is formed of: a cover pressure-bonding section which pressure-bonds by caulking the cover body in the vicinity of a distal end of the cover body; and a conductor pressure-bonding section which pressure-bonds by caulking the wire conductor which is exposed from the distal end of the cover body by a predetermined length in a long length direction of the insulated wire, the method including: at the time of pressure-bonding the cover body by caulking the barrel portion which is formed of: the cover pressure-bonding section which is configured such that a cross-sectional shape of the cover pressure-bonding section in a short length direction of the insulated wire is formed into a closed cross-sectional shape which surrounds the cover body, and the cover pressure-bonding section extends by a predetermined length in the long length direction; and the conductor pressure-bonding section which is configured such that the cover pressure-bonding section is formed by extending the cover pressure-bonding section in the long length direction, and a cross-sectional shape of the conductor pressure-bonding section in a short length direction is formed into a closed cross-sectional shape which surrounds the wire conductor, forming a compression portion which is disposed on a boundary between an inner surface of the cover pressure-bonding section and an outer surface of the cover body into a projection shape which projects toward the center of the insulated wire in the short length direction from the inner surface of the cover pressure-bonding section by compressing the cover body in the short length direction.

According to the present invention, it is possible to form the compression portion more surely following the deformation of the cover pressure-bonding section at the time of pressure-bonding. Accordingly, the method of manufacturing a connection structural body can suppress the formation of the compression portion in a deformed shape and, at the same time, can close the gap formed between the cover body and the cover pressure-bonding section more surely.

Further, the compression portion can be formed simultaneously with the step of pressure-bonding the cover pressure-bonding section to the cover body by caulking and hence, in the method of manufacturing a connection structural body, a special step for forming the compression portion is unnecessary.

Accordingly, the method of manufacturing a connection structural body can efficiently form the compression portion and, at the same time, can secure water-blocking performance more surely.

According to another aspect of the present invention, the method of manufacturing a connection structural body may include: forming an inner peripheral portion of at least a proximal end portion of the pressure-bonding section in the long length direction with a proximal-end-side large-diameter inner peripheral portion which has an inner diameter larger than inner diameters of portions of the pressure-bonding section other than the at least the proximal end portion in the long length direction.

According to the present invention, the inner peripheral portion of at least the proximal end portion of the pressure-bonding section in the long length direction can surely have the larger inner diameter than portions other than the at least the proximal end portion of the pressure-bonding section in the long length direction. Accordingly, in a state where the pressure-bonding section is pressure-bonded to a distal end portion of the wire, a pressure-bonding force with which a proximal end side of the cover pressure-bonding section pressure-bonds the insulating cover can be alleviated thus surely preventing a drawback that the insulating cover ruptures.

Effects of the Invention

According to the present invention, it is possible to provide a connection structural body which can surely prevent the intrusion of moisture from a cover body side, a connector and a method of manufacturing a connection structural body.

EMBODIMENT OF THE INVENTION

One embodiment of the present invention is described hereinafter by reference to the drawings.

Firstly, an insulated wire 200 and a crimp terminal 100 according to this embodiment are described in detail by reference to FIG. 1 and FIGS. 2(*a*) and 2(*b*).

Figure 1:
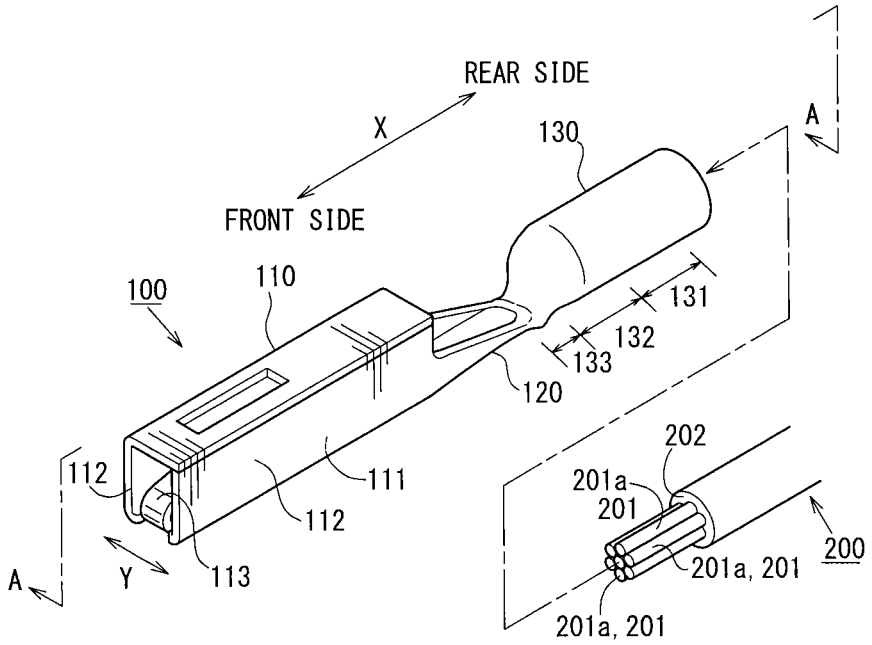
FIG. 1 is an appearance perspective view showing an appearance of an insulated wire and a crimp terminal as viewed from above.
Figure 2A:
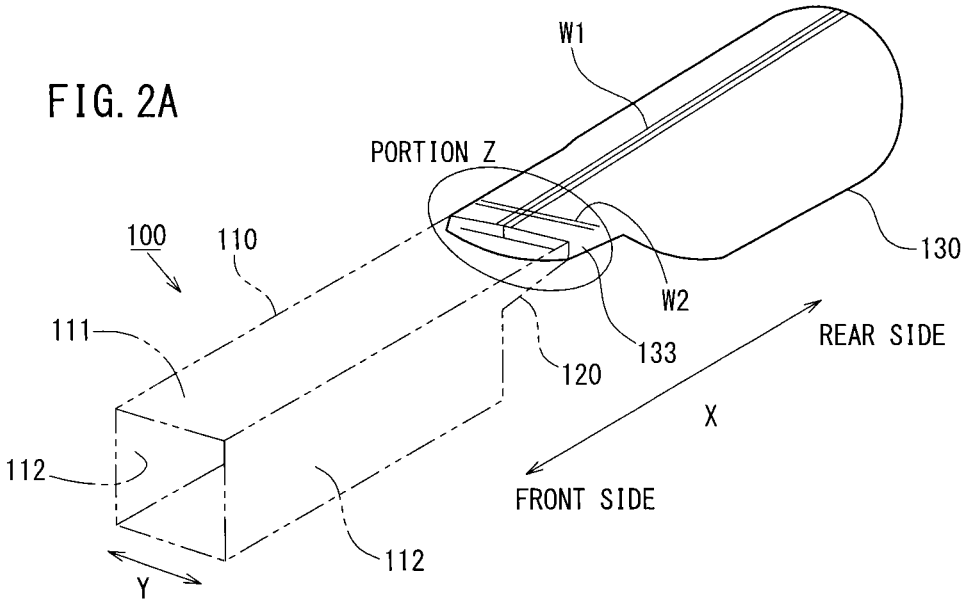
FIGS. 2(*a*) and 2(*b*) are explanatory views for describing welding in a barrel portion.
Figure 2B:
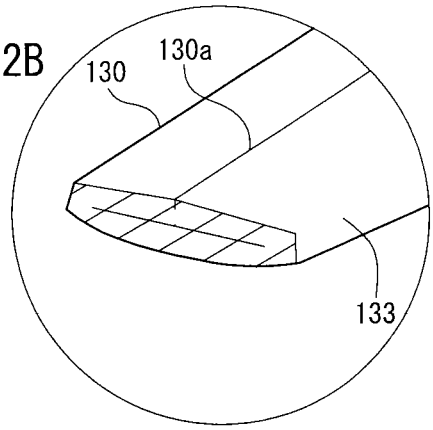

FIG. 1 is an appearance perspective view of the insulated wire 200 and the crimp terminal 100 as viewed from above, and FIGS. 2(*a*) and 2(*b*) are explanatory views for describing welding in a barrel portion 130.

In FIG. 1, an arrow X indicates the long length direction (hereinafter referred to as "long length direction X"), and an arrow Y indicates the width direction (hereinafter referred to as "width direction Y"). Further, in the long length direction X, a box portion 110 side (a left side in the drawing) described later is referred to as a front side, and an insulated wire 200 side (a right side in the drawing) described later with respect to a box portion 110 is referred to as a rear side.

Further, FIG. 2(*a*) is a schematic perspective view showing a bottom surface side of the crimp terminal 100 where the box portion 110 is shown in a see-through state indicated by double-dashed chain lines, and FIG. 2(*b*) is an enlarged view of a portion Z in FIG. 2(*a*).

The insulated wire 200 is formed by covering, with an insulating cover 202 made of an insulation resin, an aluminum core wire 201 formed by binding aluminum raw wires 201*a*. This will be described in more detail. The aluminum core wire 201 is formed by twisting aluminum alloy wires such that the aluminum core wire 201 has a cross section of 0.75 $mm^2$. Further, in the insulated wire 200, the aluminum core wire 201 is exposed by a predetermined length from a distal end of the insulating cover 202.

The crimp terminal 100 is a female terminal, and is an integral body formed of the box portion 110 and the barrel portion 130 which are arranged in a front side and a rear side in the long length direction X, respectively, with a transition section 120 having a predetermined length interposed therebetween, the box portion 110 allows the insertion of a male tub of a male terminal not shown in the drawing, the barrel portion 130 arranged behind the box portion 110.

The crimp terminal 100 is a closed barrel-type terminal which is formed in such a way that a copper alloy strip made of brass or the like (not shown in the drawing) and having a surface plated with tin (Sn plating) is blanked in a shape a terminal developed in plane and, thereafter, the strip is formed by bending into a stereoscopic terminal shape formed of the box portion 110 having a hollow quadrangular columnar body and the barrel portion 130 having an approximately O shape as viewed from a rear side, and the barrel portion 130 is welded.

The box portion 110 is formed of an inverted hollow quadrangular columnar body having an approximately rectangular shape as viewed from a front side in the long length direction X where one of side surface portions 112 contiguously formed on both side portions in the width direction Y which intersects with the long length direction X of the bottom surface portion 111 is bent such that one side surface portion 112 overlaps with an end portion on the other side surface portion 112.

Figures 3A, 3B:
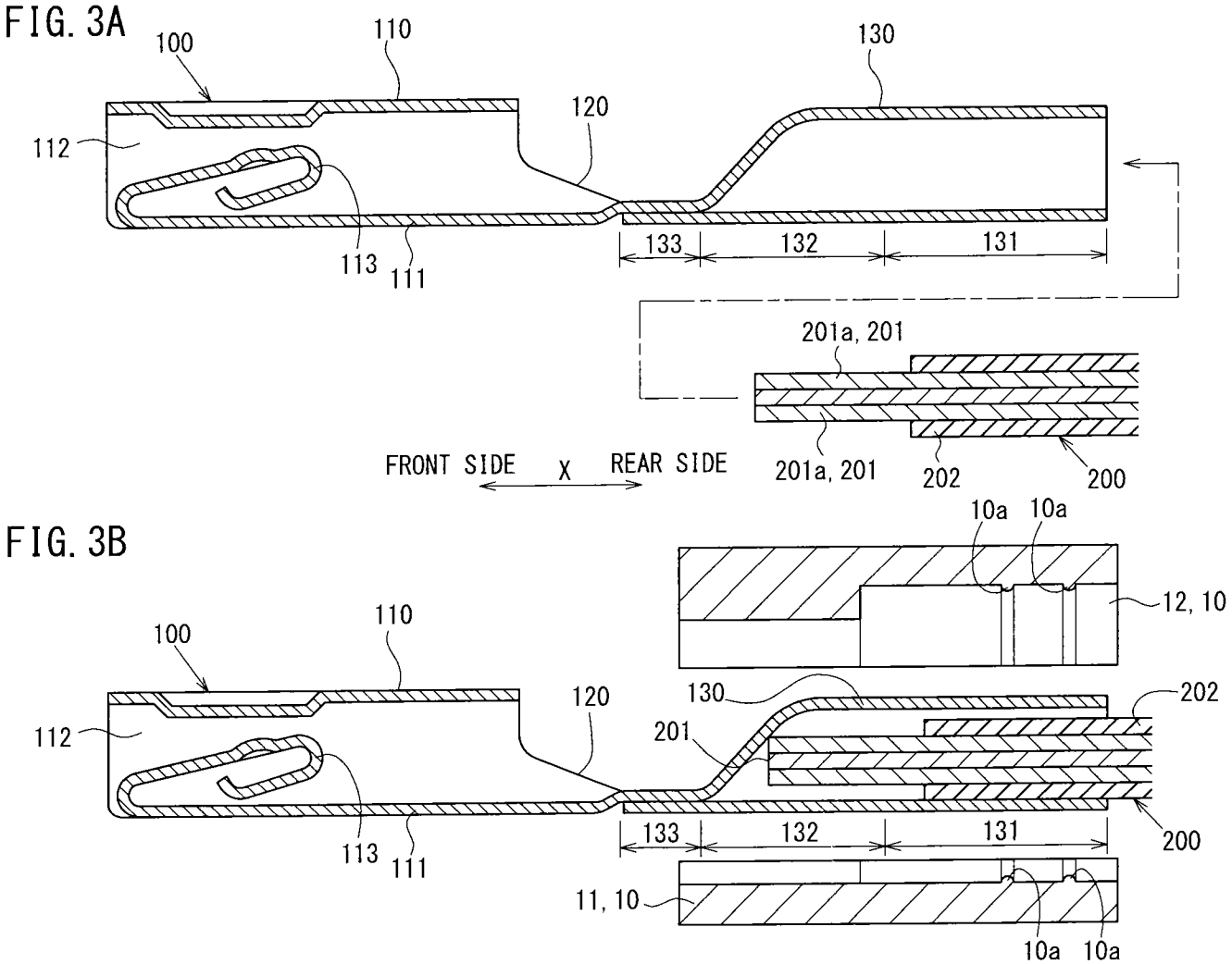
FIGS. 3(*a*) and 3(*b*) are explanatory views for describing a caulking step in a cross section taken along line A-A in FIG. 1.

In the inside of the box portion 110, a resilient contact lug 113 (see FIGS. 3(*a*) and 3(*b*)) which is brought into contact with an insertion tub (not shown in the drawing) of a male terminal to be inserted is provided. The resilient contact lug 113 is formed by extending a front side of the bottom surface portion 111 in the long length direction X and by bending the extending portion toward a rear side in the long length direction X.

The barrel portion 130 is formed of; an integral body constituted of a cover pressure-bonding section 131 which pressure-bonds the insulating cover 202 and a core wire pressure-bonding section 132 which pressure-bonds the exposed aluminum core wire 201; and a sealing portion 133 which is formed by deforming an end portion in front of the core wire pressure-bonding section 132 in such a manner that the end portion is pressed down into an approximately flat plate shape.

The barrel portion 130 is, as shown in FIGS. 2(*a*) and 2(*b*), formed into an approximately O shape as viewed from a rear side in such a way that the barrel portion 130 formed of the copper alloy strip blanked in a terminal shape is rounded to have a size that the barrel portion 130 surrounds an outer periphery of the insulated wire 200, edge portions 130*a* of the rounded barrel portion 130 are made to abut against each other, and the edge portions 130*a* are welded together along a welding portion W1 in the long length direction X. That is, the barrel portion 130 is formed such that a cross-sectional shape of the barrel portion 130 in the width direction Y becomes a closed cross-sectional shape.

Further, the sealing portion 133 of the barrel portion 130 is, as shown in FIG. 2(*a*), sealed by welding along a welding portion W2 in the width direction Y so as to close a front end of the barrel portion 130 in the long length direction X.

That is, the barrel portion 130 is formed into an approximately cylindrical shape having an opening on a rear side of the barrel portion 130 in the long length direction X where the front end of the barrel portion 130 in the long length direction X and the edge portions 130*a* of the barrel portion 130 are closed by welding.

Figure 4:
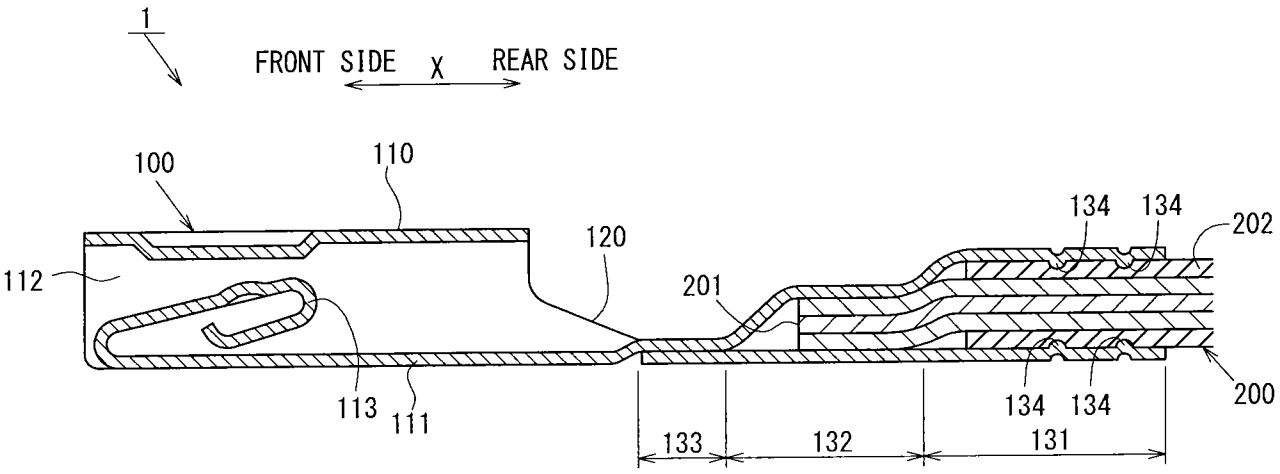
FIG. 4 is a cross-sectional view showing a cross-sectional shape of a pressure-bonding connection structural body in a cross section taken along line A-A in FIG. 1.

Next, steps are described in detail by reference to FIGS. 3(*a*) and 3(*b*) and FIG. 4 where the insulated wire 200 is inserted into the barrel portion 130 of the crimp terminal 100 having such a configuration, the barrel portion 130 is pressure-bonded by caulking, and water blocking projecting portions 134 which stop moisture intruded into the inside of the barrel portion 130 from a rear side in the long length direction X are formed at the time of pressure-bonding the barrel portion 130 by caulking. Further, the pressure-bonding connection structural body 1 after pressure-bonding is described in detail by reference to FIGS. 3(*a*) and 3(*b*) and FIG. 4.

FIG. 3(*a*) and FIG. 3(*b*) are cross-sectional views taken along line A-A in FIG. 1 and are explanatory views for describing the caulking step. FIG. 4 is a cross-sectional view taken along line A-A in FIG. 1 and shows a cross-sectional shape of the pressure-bonding connection structural body 1.

FIG. 3(*a*) is the cross-sectional view taken along line A-A in FIG. 1, and FIG. 3(*b*) is the explanatory view for describing the step of caulking the crimp terminal 100 into which the insulated wire 200 is inserted using a pressure-bonding tool 10.

As shown in FIG. 3(*a*), the insulated wire 200 from which the aluminum core wire 201 is exposed is inserted into the inside of the barrel portion 130 of the above-mentioned crimp terminal 100 from a rear side. In this case, the insulated wire 200 is inserted into the barrel portion 130 such that the exposed aluminum core wire 201 is arranged in the core wire pressure-bonding section 132 as shown in FIG. 3(*b*).

Then, as shown in FIG. 3(*b*), the barrel portion 130 of the crimp terminal 100 into which the insulated wire 200 is inserted is caulked such that the barrel portion 130 is sandwiched between one set of pressure-bonding tools 10 formed of an anvil and a crimper.

As shown in FIG. 3(*b*), this one set of pressure-bonding tools 10 is formed of a first pressure-bonding die 11 which constitutes the anvil and a second pressure-bonding die 12 which constitutes the crimper. An inner surface shape of the pressure-bonding tool 10 is formed into a shape corresponding to an outer surface shape of the cover pressure-bonding section 131 and an outer surface shape of the core wire pressure-bonding section 132 after pressure-bonding.

Two die projecting portions 10*a* are formed on an inner surface of the pressure-bonding tool 10 corresponding to the cover pressure-bonding section 131 in a spaced-apart manner with a predetermined distance therebetween in the long length direction X. A cross-sectional shape of the die projecting portion 10*a* in the long length direction X is formed into an approximately convex shape projecting toward the insulated wire 200 from the inner surface of the pressure-bonding tool 10, and the die projecting portion 10*a* is continuously formed without being interrupted along the circumferential direction which intersects with the long length direction X.

The barrel portion 130 of the crimp terminal 100 into which the insulated wire 200 is inserted is caulked by the pressure-bonding tool 10. That is, the core wire pressure-bonding section 132 and the cover pressure-bonding section 131 of the barrel portion 130 are caulked in such a manner that these sections are caulked while being sandwiched between one set of the pressure-bonding tools 10 so that the aluminum core wire 201 and the insulating cover 202 are pressure-bonded to each other whereby the pressure-bonding connection structural body 1 is formed.

This will be described in more detail. As shown in FIG. 4, in the pressure-bonding connection structural body 1, the core wire pressure-bonding section 132 and the aluminum core wire 201 are pressure-bonded to each other by caulking the core wire pressure-bonding section 132 by the pressure-bonding tool 10 so that the core wire pressure-bonding section 132 and the aluminum core wire 201 are connected to each other in a conductive manner. By caulking the cover pressure-bonding section 131 by the pressure-bonding tool 10, the cover pressure-bonding section 131 and the insulating cover 202 are pressure-bonded to each other and hence, the cover pressure-bonding section 131 and the insulating cover 202 are connected to each other. Further, by the die projecting portions 10*a* of the pressure-bonding tool 10, on the cover pressure-bonding section 131, two water blocking projecting portions 134 each having an approximately convex shape where a cross-sectional shape in the long length direction X projects toward the center of the insulated wire 200 in the radial direction from an inner surface are formed in a spaced-apart manner in the long length direction X by a predetermined distance.

The water blocking projecting portions 134 are continuously formed without being interrupted on an inner surface of the cover pressure-bonding section 131 along the circumferential direction which intersects with the long length direction X. The water blocking projecting portions 134 further compress the insulating cover 202 in a pressure-bonding state toward the center of the insulated wire 200 in the radial direction.

An advantageous effect brought about by the water blocking projecting portions 134 can be more increased by forming the water blocking projecting portions 134 within a range of 10% to 50% with respect to a length of the cover pressure-bonding section 131 in the long length direction X. Provided that the water blocking projecting portions 134 are formed within such a range, the number of water blocking projecting portions 134 is not limited to two and may be one, three or more.

In this manner, it is possible to provide the pressure-bonding connection structural body 1 where the insulated wire 200 is connected to the crimp terminal 100 due to pressure-bonding by caulking of the barrel, and the conductivity between the aluminum core wire 201 and the crimp terminal 100 can be secured.

Next, a connector which mounts the above-mentioned pressure-bonding connection structural body 1 in the inside of a connector housing is described by reference to FIG. 5.

Figure 5:
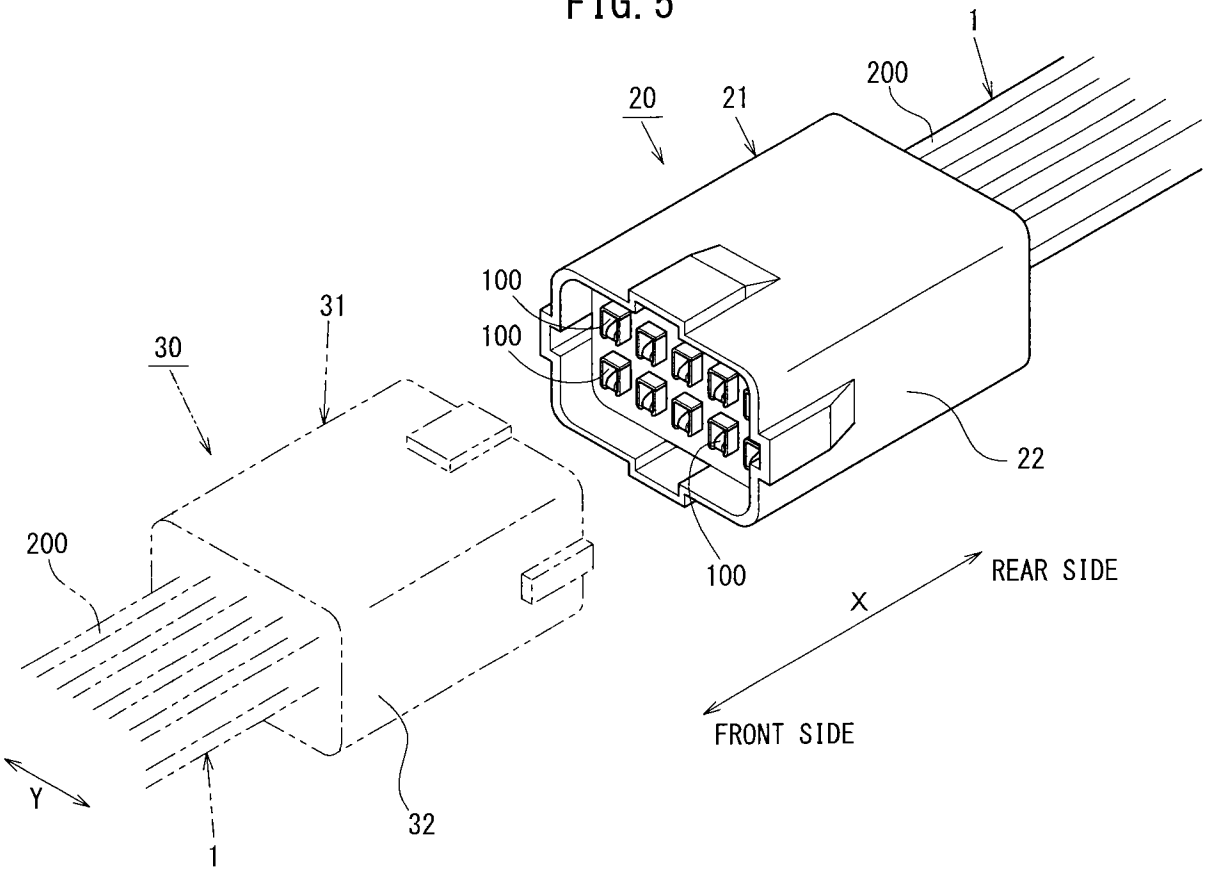
FIG. 5 is a perspective view showing connection correspondence state between a female connecter and a male connector.

FIG. 5 is a perspective view showing a connection correspondence state between a female connector 21 and a male connector 31. In FIG. 5, the male connector 31 is indicated by a double-dashed chain line.

A female connector housing 22 has a plurality of openings in each of which the crimp terminal 100 is mountable in the long length direction X in the inside thereof. The female connector housing 22 is formed into a box shape where a cross-sectional shape of the female connector housing 22 in the width direction Y is an approximately rectangular. A wire harness 20 having the female connector 21 is formed by mounting a plurality of pressure-bonded connection structural bodies 1 each of which is formed of the above-mentioned crimp terminal 100 into the female connector housing 22 in the long length direction X.

The male connector housing 32 which corresponds to the female connector housing 22 has, in the same manner as the female connector housing 22, a plurality of openings in each of which the crimp terminal is mountable. The male connector housing 32 has an approximately rectangular shape in cross section in the width direction Y, and is configured to be connectable to the female connector housing 22 due to convex and concave engagement relationship.

A wire harness 30 having the male connector 31 is formed by mounting the pressure-bonded connection structural bodies 1 each of which is formed of a male crimp terminal not shown in the drawing into the male connector housing 32 in the long length direction X.

The wire harness 20 and the wire harness 30 are connected to each other by making the female connector 21 and the male connector 31 engage with each other by fitting engagement.

The pressure-bonding connection structural body 1, the female connector 21 and the method of manufacturing the pressure-bonding connection structural body 1 which realize the above-mentioned configuration can surely prevent the intrusion of moisture from an insulating cover 202 side.

This will be described in more detail. By providing the sealing portion 133 to the front end of the barrel portion 130, the crimp terminal 100 can prevent the intrusion of moisture from the front end of the barrel portion 130. Further, by forming the water blocking projecting portions 134 on the inner peripheral surface of the cover pressure-bonding section 131, the crimp terminal 100 can prevent the intrusion of moisture into the inside of the barrel portion 130 from a rear end portion of the barrel portion 130.

That is, the crimp terminal 100 can bring the inside of the barrel portion 130 in a pressure-bonding state into a hermetically closed state by the sealing portion 133 and the water blocking projecting portions 134. Accordingly, the crimp terminal 100 can more surely prevent the intrusion of moisture into the inside of the barrel portion 130.

This will be described in more detail. By further compressing the insulating cover 202 in a pressure-bonding state by the water blocking projecting portions 134, a gap formed between the insulating cover 202 and the cover pressure-bonding section 131 can be surely closed by a repulsive force of the insulating cover 202. Accordingly, at the time of caulking the cover pressure-bonding section 131 to the insulating cover 202, it is possible to surely close a gap which is formed due to the deformation of the cover pressure-bonding section 131.

Further, by forming the water blocking projecting portions 134 on the cover pressure-bonding section 131 at the time of pressure-bonding the barrel portion 130, it is possible to suppress damage and degradation due to external factors and hence, it is possible to prevent the intrusion of moisture into the inside of the cover pressure-bonding section 131 more continuously.

Further, by forming the water blocking projecting portions 134 along the circumferential direction with no gap as viewed from a rear side, it is possible to prevent the intrusion of moisture into the inside of the cover pressure-bonding section 131 in a pressure-bonding state more surely.

Further, by forming the water blocking projecting portions 134 into projection shapes, the insulating cover 202 can be compressed more surely. Still further, the insulating cover 202 is deformed into an approximately uneven shape by the water blocking projecting portions 134 each having a projection shape and hence, it is possible to make an intrusion path of moisture more complicated and to elongate a distance of the intrusion path. Accordingly, it is possible to make it more difficult for moisture intruded into a gap formed between the insulating cover 202 and the cover pressure-bonding section 131 to reach the aluminum raw wires 201*a*.

In addition to the above, the water blocking projecting portions 134 each having a projection shape bite into the insulating cover 202 due to pressure-bonding and hence, even when a pulling force is applied to the insulated wire 200 in the long length direction X by chance, it is possible to prevent the insulated wire 200 from being easily removed from the crimp terminal 100.

Accordingly, due to the formation of the sealing portion 133 and the water blocking projecting portions 134, the crimp terminal 100 can secure more reliable water-blocking performance in a pressure-bonding state and hence, it is possible to prevent the intrusion of moisture into the inside of the barrel portion 130 more surely.

With the use of the crimp terminal 100 on which the above-mentioned water blocking projecting portions 134 are formed, it is possible to provide the pressure-bonding connection structural body 1 which can secure the reliable water-blocking performance by merely pressure-bonding the insulated wire 200 to the barrel portion 130 of the crimp terminal 100.

Accordingly, the pressure-bonding connection structural body 1 can secure the more stable conductivity.

By forming the female connector 21 by arranging the crimp terminals 100 of the pressure-bonded connection structural bodies 1 into the inside of the female connector housing 22, in connecting the crimp terminals of the male connector 31 to the crimp terminals 100 arranged in the inside of the female connector housing 22, the crimp terminals 100 of the female connector 21 can be connected to the male connector 31 while ensuring water-blocking performance.

Accordingly, the female connector 21 can secure a connection state having reliable conductivity.

By forming the core wire of the insulated wire 200 using an aluminum alloy and by forming the barrel portion 130 using a copper alloy, the insulated wire 200 can be made more light-weighted than the insulated wire 200 having a core wire formed of a copper wire. Further, due to the reliable water-blocking performance brought about by the sealing portion 133 and the water blocking projecting portions 134, it is possible to prevent the occurrence of galvanic corrosion between the crimp terminal 100 and the insulated wire 200 which are made of different materials.

By adopting the method of manufacturing the pressure-bonding connection structural body 1 where the water blocking projecting portions 134 are formed on the cover pressure-bonding section 131 at the time of caulking the cover pressure-bonding section 131 to the insulating cover 202, the water blocking projecting portions 134 can be surely formed following the deformation of the cover pressure-bonding section 131. Accordingly, in the method of manufacturing the pressure-bonding connection structural body 1, it is possible to prevent the water blocking projecting portions 134 from being formed into distorted shapes and, at the same time, it is possible to close a gap formed between the insulating cover 202 and the cover pressure-bonding section 131 more surely.

Further, the water blocking projecting portions 134 can be formed simultaneously with the step of pressure-bonding the cover pressure-bonding section 131 to the insulating cover 202 by caulking and hence, in the method of manufacturing the pressure-bonding connection structural body 1, a special step for forming the water blocking projecting portions 134 is unnecessary.

Accordingly, the method of manufacturing the pressure-bonding connection structural body 1 can efficiently form the water blocking projecting portions 134 and, at the same time, can secure water-blocking performance more surely.

In the above-mentioned Embodiment 1, the water blocking projecting portions 134 each having a projection shape are formed on the inner surface of the cover pressure-bonding section 131. Each of the water blocking projecting portions 134 is not limited to such a shape, and may have any desired shape provided that the water blocking projecting portions 134 can compress the insulating cover 202.

Figures 6A, 6B, 6C:
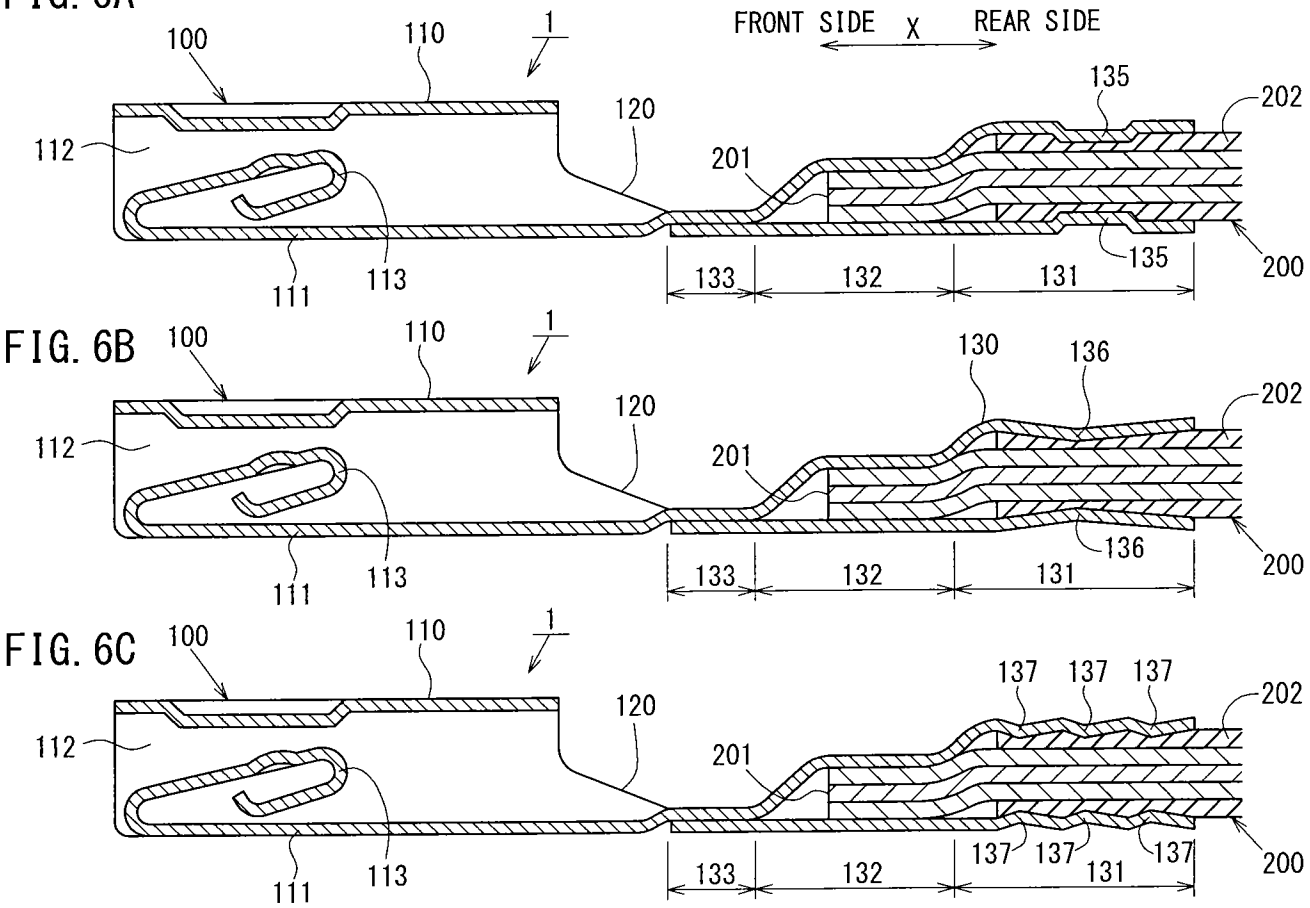
FIGS. 6(*a*) to 6(*c*) are explanatory views for describing another cross-sectional shape of the pressure-bonding connection structural body.

For example, FIG. 6(*a*) to FIG. 6(*c*) are explanatory views for describing other cross-sectional shapes with respect to the pressure-bonding connection structural body 1. As shown in FIG. 6(*a*), at the time of caulking the cover pressure-bonding section 131 using a pressure-bonding tool 10, a trapezoidal projecting portion 135 may be formed such that the trapezoidal projecting portion 135 has a cross-sectional shape in the long length direction X formed into a hat shape projecting toward the center of the insulated wire 200 in the radial direction from the inner surface of the cover pressure-bonding section 131 and is formed continuously along the circumferential direction without being interrupted.

As shown in FIG. 6(*b*), as another example of the cross-sectional shape with respect to pressure-bonding connection structural body 1, at the time of caulking the cover pressure-bonding section 131 using a pressure-bonding tool 10, a narrowed diameter portion 136 may be formed such that a diameter of a portion of the cover pressure-bonding section 131 is narrowed.

As shown in FIG. 6(*c*), as another example of the cross-sectional shape with respect to pressure-bonding connection structural body 1, at the time of caulking the cover pressure-bonding section 131 using a pressure-bonding tool 10, a plurality of approximately crest projecting portions 137 may be formed in a spaced-apart manner in the long length direction X at a predetermined interval such that the crest projecting portion 137 has a cross-sectional shape in the long length direction X formed into a crest shape projecting toward the center of the insulated wire 200 in the radial direction from the inner surface of the cover pressure-bonding section 131 and is formed continuously along the circumferential direction without being interrupted.

By further compressing the insulating cover 202 in a pressure-bonding state by the trapezoidal projecting portion 135, the narrowed diameter portion 136 or the crest projecting portion 137, the crimp terminal 100 and the pressure-bonding connection structural body 1 can secure water-blocking performance surely as well as the case of the water blocking projecting portions 134.

In this case, it is assumed that the cover pressure-bonding section 131 is caulked by the pressure-bonding tool 10 having an inner surface formed into a shape corresponding to a shape of the cover pressure-bonding section 131 after pressure-bonding.

In the above-mentioned explanation, the crimp terminal 100 is formed of a female crimp terminal. However, the crimp terminal 100 is not limited to such a female crimp terminal, and may be formed of a male crimp terminal which is engaged with a female crimp terminal 100 in the long length direction X by fitting engagement.

Further, the core wire of the insulated wire 200 is made of an aluminum alloy, and the crimp terminal 100 is made of a copper alloy such as brass. However, materials for forming the insulated wire 200 and the crimp terminal 100 are not limited to the above-mentioned materials, and the core wire of the insulated wire 200 and the crimp terminal 100 may be formed using the same metal, for example, a copper alloy such as brass or an aluminum alloy.

The following describes the correspondence between the configuration of the present invention and the configuration of the above-mentioned embodiment.

The wire conductor of the present invention corresponds to the aluminum core wire 201 of the embodiment.

In the same manner, the cover body of the present invention corresponds to the insulating cover 202 of the embodiment, the conductive pressure-bonded portion of the present invention corresponds to the core wire pressure-bonding section 132 of the embodiment, the short length direction of the present invention corresponds to the width direction Y of the embodiment, the compression portion of the present invention corresponds to the water blocking projecting portions 134, the trapezoidal projecting portion 135, the narrowed diameter portion 136, and the crest projecting portion 137 of the embodiment, the compression portion of the present invention corresponds to the water blocking projecting portion 134, the trapezoidal projecting portion 135, the narrowed diameter portion 136, and the crest projecting portion 137 of the embodiment, an aluminum-based material of the present invention corresponds to an aluminum alloy of the embodiment, a copper-based material of the present invention corresponds to a copper alloy strip such as the brass strip of the embodiment, the connection structural body of the present invention corresponds to the pressure-bonding connection structural body 1 of the embodiment, the connector housing of the present invention corresponds to the female connector housing 22 and the male connector housing 32 of the embodiment, and the connector of the present invention corresponds to the female connector 21 and the male connector 31 of the embodiment.

The present invention is not limited to the configuration of the above-mentioned embodiment, and can take various embodiments.

In the embodiment described herein, the explanation has been made by taking the example where the barrel portion 130 of the crimp terminal 100 is connected by pressure-bonding to the aluminum core wire 201 made of a less noble metal such as aluminum or an aluminum alloy. However, the barrel portion 130 of the crimp terminal 100 may be connected by pressure-bonding to a conductive portion made of a nobler metal material such as copper or a copper alloy, for example, besides the less noble metal. With such an example, there can be also acquired the substantially same manner of operation and advantageous effects as the above-mentioned embodiment.

This will be described in more detail. The barrel portion 130 having the above-mentioned configuration can prevent the intrusion of moisture in a pressure-bonding state. Accordingly, for example, an insulated wire constituted of a core wire made of copper, a copper alloy or the like may be connected, which conventionally needs sealing or the like after pressure-bonding for water blocking between wires.

For example, in the above-mentioned embodiment, as shown in FIG. 2(*a*) and FIG. 2(*b*), the barrel portion 130 formed into an approximately cylindrical shape having an opening on a rear side thereof in the long length direction X is formed in such a way that the copper alloy strip blanked in a terminal shape is rounded, the edge portions 130*a* of the rounded barrel portion 130 are made to abut against each other and are welded to each other along a welding portion W1 in the long length direction X thus forming the barrel portion 130 having an approximately O shape as viewed from a rear side, the front end portion of the barrel portion 130 in the long length direction X is pressed down, and the barrel portion 130 is welded along the welding portion W2 in the width direction Y, the front end of the barrel portion 130 in the long length direction X is sealed at the sealing portion 133. However, as shown in FIG. 7(*a*) to FIG. 7(*c*) which describe another method of welding for forming the barrel portion 130, the barrel portion 130 may be formed in such a way that a shape of the barrel portion 130 is formed and, thereafter, a portion to be welded is welded.

This will be described in more detail. As shown in FIG. 7(*a*), a copper alloy strip blanked into a terminal shape is rounded, and the front end portion of the rounded strip in the long length direction X is pressed down thus previously forming the rounded strip into the shape of the barrel portion 130 including the sealing portion 133.

Subsequently, the edge portions 130*a* which are made to abut against each other by rounding are welded to each other along a welding portion W3 in the long length direction X, and the edge portions 130*a* are sealed to each other by welding along the welding portion W4 in the width direction Y in the sealing portion 133 thus completing the barrel portion 130.

Figures 7A, 7B, 7C:
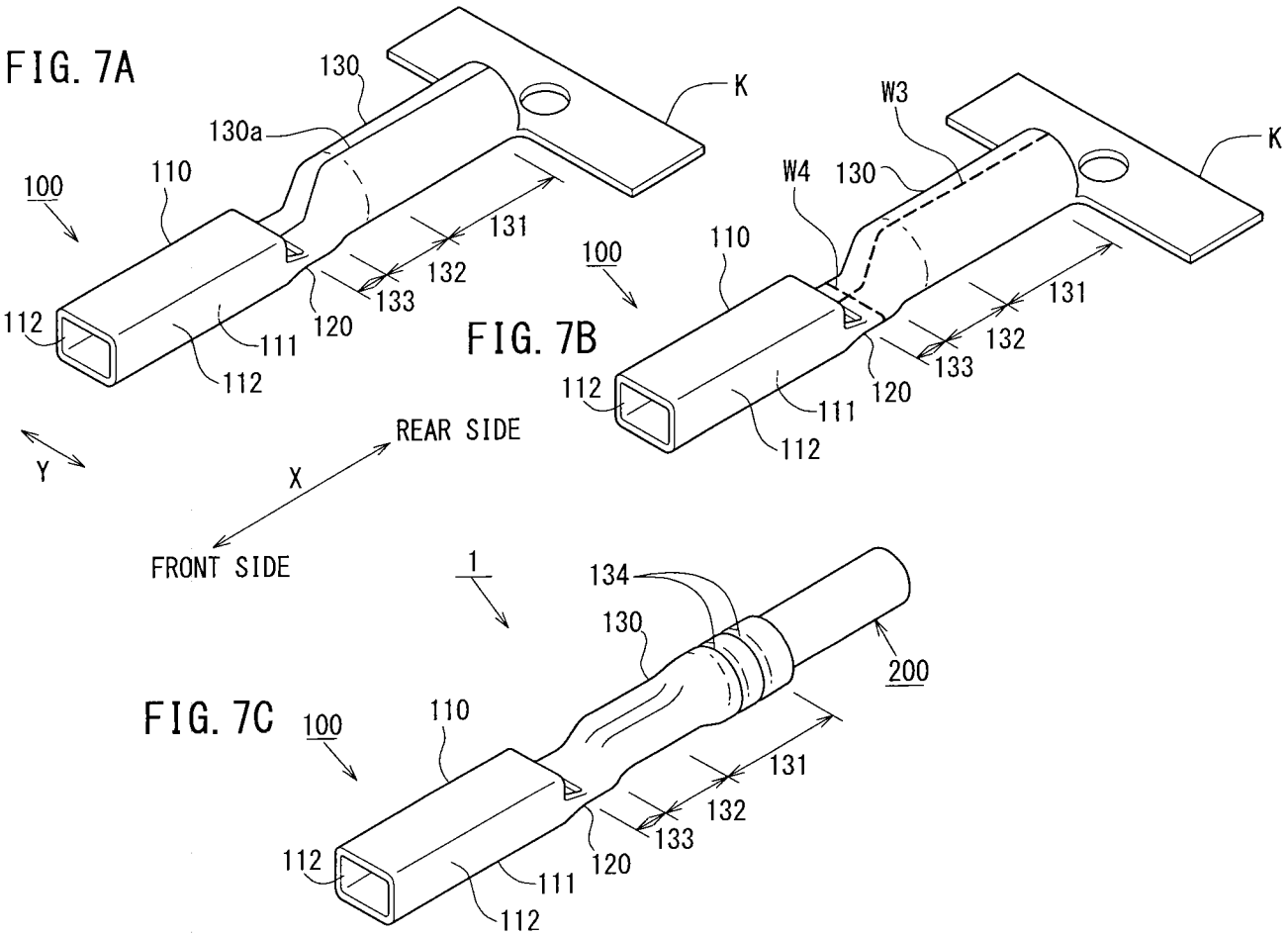
FIGS. 7(*a*) to 7(*c*) are explanatory views for describing another welding method in the barrel portion.

While the edge portions 130*a* of the barrel portion 130 may be made to abut against each other and may be welded to each other on a bottom surface side of the barrel portion 130 as shown in FIG. 2(*a*) and FIG. 2(*b*), the edge portions 130*a* of the barrel portion 130 may be made to abut against each other and may be welded to each other on an upper surface side of the barrel portion 130 as shown in FIG. 7(*a*) and FIG. 7(*b*).

As shown in FIG. 7(*c*), the cover pressure-bonding section 131 of the barrel portion 130 may be pressure-bonded to the insulating cover 202 of the insulated wire 200 in a circular shape as viewed from a front side in a pressure-bonding state, and the core wire pressure-bonding section 132 may be pressure-bonded to the aluminum core wire in an approximately U shape as viewed from the front side.

As shown in FIG. 7(*a*) to FIG. 7(*c*), first the barrel portion 130 may welded in a state where the crimp terminal 100 is mounted on a carrier K in a strip shape, and then the crimp terminal 100 may be separated from the carrier K at the time of connecting the insulated wire 200 to the barrel portion 130 by pressure-bonding or after the completion of the connection of the insulated wire 200 to the barrel portion 130. However, the crimp terminal 100 may be formed in a state where the crimp terminal 100 is separated from the carrier K and the insulated wire 200 may be connected to the crimp terminal 100 by pressure-bonding.

Further, in the cover pressure-bonding section 131 of the barrel portion 130, a sealing material having water-blocking performance may be interposed between an inner surface of the cover pressure-bonding section 131 and the insulating cover 202 of the insulated wire 200 and may be pressure-bonded thus enhancing water-blocking performance at a rear side of the barrel portion 130.

Figure 8A:
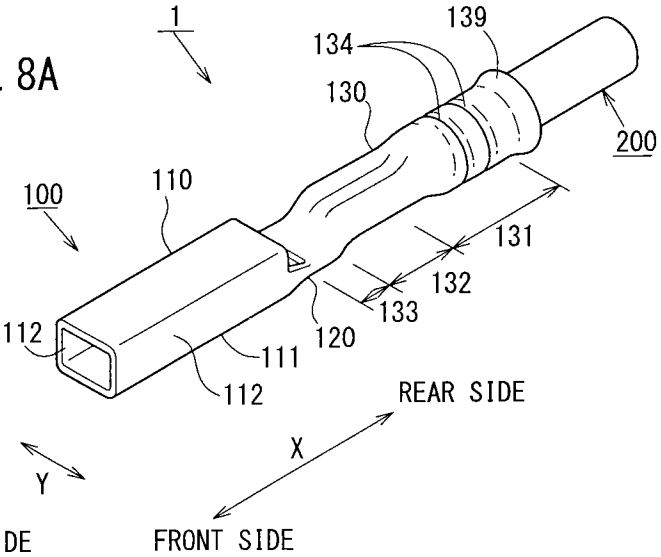
FIGS. 8(*a*) and 8(*b*) are explanatory views for describing another pressure-bonding mode in the barrel portion welded by another welding method.
Figure 8B:
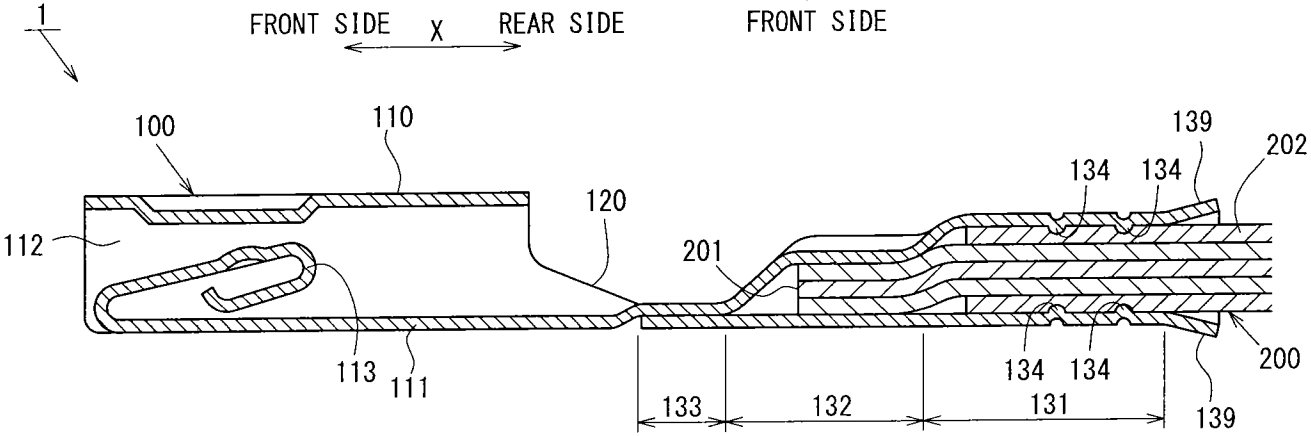

Still further, as shown in FIG. 8(*a*) and FIG. 8(*b*) which are explanatory views for describing another pressure-bonding state of the barrel portion 130 which is welded by the above-mentioned another welding method, a proximal end side enlarged diameter portion 139 may be formed on a proximal end portion side (a rear side in the long length direction X) of the barrel portion 130.

FIG. 8(*a*) is a perspective view of the pressure-bonding connection structural body 1 on which the proximal end side enlarged diameter portion 139 is formed, and FIG. 8(*b*) is a longitudinal cross-sectional view of the pressure-bonding connection structural body 1.

As shown in FIG. 8(*a*) and FIG. 8(*b*), in the pressure-bonding connection structural body 1 where the proximal end side enlarged diameter portion 139 is formed on the proximal end portion of the cover pressure-bonding section 131 of the barrel portion 130, at the time of pressure-bonding the insulated wire 200 by the barrel portion 130, by using a pressure-bonding tool having a smaller length in the long length direction X than the barrel portion 130, a portion of the insulated wire 200 corresponding to the proximal end side enlarged diameter portion 139 is not pressure-bonded and hence, in a pressure-bonding state, the proximal end side enlarged diameter portion 139 having a flared shape which expands toward a rear side in the long length direction X is formed.

An inner peripheral portion of the proximal end side enlarged diameter portion 139 formed on the proximal end portion of the barrel portion 130 on a rear side in the long length direction X has an inner diameter larger than an inner diameter of the cover pressure-bonding section 131 of the barrel portion 130. Accordingly, in a state where a distal end portion of the insulated wire 200 is pressure-bonded by the barrel portion 130, a pressure-bonding force with which a proximal end side of the cover pressure-bonding section 131 pressure-bonds the insulating cover 202 can be alleviated thus surely preventing a drawback that an end portion of the cover pressure-bonding section 131 bites into the insulating cover 202 and ruptures the insulating cover 202, for example.

DESCRIPTION OF REFERENCE SIGNS

1: pressure-bonding connection structural body
20: wire harness
21: female connector
22: female connector housing
31: male connector
32: male connector housing

100: crimp terminal
130: barrel portion
131: cover pressure-bonding section
132: core wire pressure-bonding section
133: sealing portion
134: water blocking projecting portion
135: trapezoidal projecting portion
136: narrowed diameter portion
137: crest projecting portion
139: proximal end side enlarged diameter portion
200: insulated wire
201: aluminum core wire
202: insulating cover
X: long length direction
Y: width direction

The invention claimed is:

1. A connection structural body which is configured by connecting a crimp terminal and an insulated wire which is formed by covering an outer periphery of a wire conductor with an insulating cover body to each other, the crimp terminal having a barrel portion which is formed of: a cover pressure-bonding section which pressure-bonds by caulking the cover body in the vicinity of a distal end of the cover body; and a conductor pressure-bonding section which pressure-bonds by caulking the wire conductor which is exposed from the distal end of the cover body by a predetermined length in a longitudinal direction of the insulated wire, wherein the barrel portion is formed of:

the cover pressure-bonding section which is configured such that a cross-sectional shape of the cover pressure-bonding section in a lateral direction of the insulated wire is formed into a closed cross-sectional shape which surrounds the cover body, and the cover pressure-bonding section extends by a predetermined length in the longitudinal direction; and the conductor pressure-bonding section which is configured such that the cover pressure-bonding section is formed by extending the cover pressure-bonding section in the longitudinal direction, and a cross-sectional shape of the conductor pressure-bonding section in the lateral direction is formed into a closed cross-sectional shape which surrounds the wire conductor, and a compression portion which is formed into a projection shape and projects toward the center of the insulated wire in the lateral direction from an inner surface of the cover pressure-bonding section at the time of pressure-bonding the cover body by caulking the barrel portion is disposed on a boundary between the inner surface of the cover pressure-bonding section and an outer surface of the cover body.

2. The connection structural body according to claim 1, wherein the compression portion is formed in a direction which intersects with the longitudinal direction and is formed with no gap along the inner surface of the cover pressure-bonding section as viewed in the longitudinal direction.

3. The connection structural body according to claim 1, wherein a sealing member having waterproof property is formed on an inner peripheral surface of the cover pressure-bonding section or on an outer peripheral portion of the cover body in the vicinity of the distal end of the cover body.

4. The connection structural body according to claim 1, wherein the barrel portion includes a sealing portion which is formed by extending the conductor pressure-bonding section in the longitudinal direction, and seals a distal end of the barrel portion in the longitudinal direction.

5. The connection structural body according to claim 1, wherein the cover pressure-bonding section includes a proximal-end-side large-diameter inner peripheral portion where an inner peripheral portion of at least a proximal end portion of the cover pressure-bonding section in the longitudinal direction has an inner diameter larger than inner diameters of portions other than the at least the proximal end portion in the longitudinal direction of the cover pressure-bonding section.

6. The connection structural body according to claim 4, wherein the wire conductor is formed using an aluminum-based material, and at least the barrel portion is formed using a copper-based material.

7. A wire harness formed by binding a plurality of connection structural bodies described in claim 4.

8. A connector where the crimp terminal in the connection structural body described in claim 1 is arranged in the inside of a connector housing.

9. A method of manufacturing a connection structural body which is configured by connecting a crimp terminal and an insulated wire which is formed by covering an outer periphery of a wire conductor with an insulating cover body to each other, the crimp terminal having a barrel portion which is formed of: a cover pressure-bonding section which pressure-bonds by caulking the cover body in the vicinity of a distal end of the cover body; and a conductor pressure-bonding section which pressure-bonds by caulking the wire conductor which is exposed from the distal end of the cover body by a predetermined length in a longitudinal direction of the insulated wire, the method comprising:

at the time of pressure-bonding the cover body by caulking the barrel portion which is formed of: the cover pressure-bonding section which is configured such that a cross-sectional shape of the cover pressure-bonding section in a lateral direction of the insulated wire is formed into a closed cross-sectional shape which surrounds the cover body, and the cover pressure-bonding section extends by a predetermined length in the longitudinal direction; and the conductor pressure-bonding section which is configured such that the cover pressure-bonding section is formed by extending the cover pressure-bonding section in the longitudinal direction, and a cross-sectional shape of the conductor pressure-bonding section in a lateral direction is formed into a closed cross-sectional shape which surrounds the wire conductor, forming a compression portion which is disposed on a boundary between an inner surface of the cover pressure-bonding section and an outer surface of the cover body into a projection shape which projects toward the center of the insulated wire in the lateral direction from the inner surface of the cover pressure-bonding section by compressing the cover body in the lateral direction.

10. The method of manufacturing a connection structural body according to claim 9, the method comprising:

forming the compression portion in a direction which intersects with the longitudinal direction with no gap along the inner surface of the cover pressure-bonding section as viewed in the longitudinal direction.

11. The method of manufacturing a connection structural body according to claim 10, the method comprising:

forming the compression portion into a projection shape where the compression portion projects toward the center of the insulated wire in the lateral direction from the inner surface of the cover pressure-bonding section.

12. The method of manufacturing a connection structural body according to claim 9, the method comprising:

forming an inner peripheral portion of at least a proximal end portion of the cover pressure-bonding section in the longitudinal direction with a proximal-end-side large-diameter inner peripheral portion which has an inner diameter larger than inner diameters of portions of the cover pressure-bonding section other than the at least the proximal end portion in the longitudinal direction.

* * * * *